US005273282A

United States Patent [19]

Cannon

[11] Patent Number: 5,273,282

[45] Date of Patent: Dec. 28, 1993

[54] GOLF PUTTER

[76] Inventor: Julian E. Cannon, 621 S. Sylvan Dr., Brandon, Fla. 33510

[21] Appl. No.: 24,510

[22] Filed: Mar. 2, 1993

[51] Int. Cl.[5] ..... A63B 53/04

[52] U.S. Cl. ..... 273/164.1; 273/80 A; 273/167 A; 273/80 C; 273/167 G

[58] Field of Search ..... 273/167 R-77 A, 273/162 R, 164.1, 186.2, 187.4, 193 R, 194 R, 79, 129 K, 67 R; D21/214, 219, 215, 217, 218; 273/80 R, 80 A, 80 C

[56] References Cited

U.S. PATENT DOCUMENTS

D. 242,730 12/1976 Pappas ..... 273/167 J X
D. 244,303 5/1977 Cabot ..... D21/217
3,758,115 9/1973 Hoglund ..... 273/80 C X
4,290,606 9/1981 Maxwell ..... 273/175 X
4,330,128 5/1982 Morelli ..... 273/173

*Primary Examiner*—Vincent Millin
*Assistant Examiner*—Sebastiano Passaniti

[57] ABSTRACT

An improved golf putter comprising an el-shaped head, a ball striking face, a shaft connector element, and a shaft. The putter head has an elongated body, a transverse member, and a ball striking face. The shaft connector element, attached to the putter head, has a vertical segment positioned above the transverse member and an angled segment to which the shaft is connected. The shaft and the shaft connector element mask the distracting transverse features of the putter from the golfer's view during use.

16 Claims, 3 Drawing Sheets

GOLF PUTTER

BACKGROUND

1. Field of Invention

This invention relates to golf clubs and more specifically to golf clubs used for putting.

2. Description of Prior Art

There are two skills which a golfer must develop in order to putt a golf ball with the consistency and accuracy required for a good round of golf. First, the golfer must develop an ability to estimate both a target line and an initial speed for the ball which will to cause it to travel across the putting surface and fall into the hole. Second, the golfer must develop an ability to consistently aim the putter and strike the ball so that it will depart the putter very nearly along the target line and very nearly at the correct initial speed. Relatively minor putter aiming errors and initial ball speed errors can result in badly missed putts.

While natural ability and practice are required in order for a golfer to fully develop these two skills, it is very helpful for him to use a putter which provides visual alignment feedback during address, during aiming, and during the backswing and putting strokes. Undetected errors in positioning and alignment of the putter head during any of these phases of putting can cause the golfer to miss putts, make erroneous aiming compensations, and prolong or make impossible full development of his natural abilities. That designers have long recognized this fact is evidenced by the numerous examples of putter configurations and putter design schemes in the patent literature.

In general, for prior art putters, design features intended to assist the golfer in aiming, positioning and stroking the putter may be grouped into one or more of the following categories:

(a) Designs intended to help the golfer aim the putter. When a putter is properly aimed, the target line and an intersecting line drawn normal to the putter's striking face defines a vertical plane. Examples of this prior art are shown in U.S. Pat. Nos. 1,537,320 to Marsh, 3,880,430 to McCabe, 3,888,484 to Zitco, 3,888,492 to Cabot, 3,954,265 to Taylor, 4,138,117 to Dalton, 4,141,556 to Paulin, 4,659,083 to Szczepanski, 4,688,798 to Pelz, 4,962,931 to Jazdzyk, Jr., 4,964,639 to Tucker, 5,046,740 to D'Eath, 5,072,941 to Klein, and 5,125,664 to Evans.

(b) Designs intended to help the golfer position the putter head for the correct angle of lie. When a putter is positioned at the design angle of lie for his club, a line drawn normal to the striking face and an intersecting longitudinal axis of the club head defines a vertical plane. Examples of this prior art are contained in U.S. Pat. Nos. 3,549,300 to Pelz, 3,880,430 to McCabe, 4,138,117 to Dalton, 4,693,478 to Long, 5,004,237 to Antonious, 5,072,941 to Klein, 5,078,398 to Reed et al, and 5,125,664 to Evans.

(c) Designs intended to help the golfer position the putter head for the correct angle of loft. When a putter is positioned at the design angle of loft for the club, a line drawn normal to the striking face is inclined to the horizontal at the design angle of loft of the striking face. Examples of this prior art are contained in U.S. Pat. Nos. 3,549,300 to Pelz and 3,880,430 to McCabe, 4,138,117 to Dalton, 4,693,478 to Long, 4,871,174 to Kobayashi, 5,004,237 to Antonious, and 5,072,941 to Klein.

(d) Designs intended to help the golfer position the putter blub head laterally relative to the ball. Examples of this prior art are contained in U.S. Pat. Nos. 3,888,492 to Cabot, 4,138,117 to Dalton, 4,688,798 and 4,754,976 to Pelz, 4,962,931 to Jazdzyk Jr., 5,046,740 to D'Eath, 5,072,941 to Klein, and 5,125,664 to Evans.

(e) Designs which comprise putter head weight distribution schemes to help the golfer avoid introducing putter head rotational errors due to inertial effects during the backswing and putting strokes. Examples of this prior art are contained in U.S. Pat. Nos. 3,954,265 to Taylor, 4,693,478 to Long, 4,754,976 to Pelz, 4,815,739 to Donica, 4,871,174 to Kobayashi, 4,895,371 to Bushner, 4,898,387 to Finney, 5,046,740 to D'Eath, and 5,078,398 to Reed et al.

A prevalent design for conventional putter heads is that of a transverse blade of 3.5 to 5.5 inches wide (heel to toe), 0.5 to 1.5 inches long (striking face to aft end), and 0.5 to 1.5 inches high. The shaft connector elements of these conventional putters typically attach to the blade near the heel.

A consequence of using one of these conventional putters is that the golfer is provided limited visual alignment means to assist him in achieving alignment of the putter with the target line. Many of these putters provide some form of longitudinal indicia in an attempt to overcome this problem. However, it may be appreciated that considerable skill is required for the golfer to accurately position and aim a putter by orienting its most prominent feature, the transverse blade, so that it is perpendicular to the target line. The putters taught by U.S. Pat. Nos. 3,880,430 to McCabe, 4,659,083 to Szczepanski, and 4,693,478 to Long are examples of conventional blade type putters which provide short alignment indicia.

Some designers have sought to address this shortcoming of conventional putters by providing putters which have narrow, elongated bodies resembling croquet mallets. While these putter heads effectively help the golfer align the putter head with the target line, they are not in conformance with the United States Golf Association (USGA) rules of golf. Although the USGA allows far greater latitude in the design of putters than for other golf clubs, a requirement of the USGA rules is that the lateral dimension of the striking face (heel to toe) be greater than the club head's longitudinal dimension (striking face to aft end). Examples of this style putter are shown by U.S. Pat. Nos. Des. 179,002 to Hoffmeister and 179,590 to Carper.

Other prior art putter designers teach essentially tee-shaped putter heads. These putter heads combine an elongated body with a transverse member. In general, these putters conform with the USGA rules of golf provided that the striking face width is greater than the longitudinal dimension of the club head.

U.S. Pat. Nos. 4,138,117 to Dalton, 4,141,556 to Paulin, 4,688,798, to Pelz, 4,754,976 to Pelz, 4,964,639 to Tucker, and 5,072,941 to Klein all show elongated body configurations with various alignment features and indicia. While these putters provide the golfer with substantially more visual alignment capability than do conventional putters, the tee-shaped putter heads taught by these patents still present the golfer with prominent lateral features which can be distracting. Furthermore, putters in accordance with each of these patents show the shaft positioned substantially aft of the striking face.

This shaft location results in a putter which feels distinctly different from conventional putters. Experienced golfers can be distracted by this feel during the backswing and putting strokes.

U.S. Pat. Nos. 1,537,320 to Marsh, 3,888,484 to Zitco, 3,888,492 to Cabot, 4,895,371 to Bushner, 4,962,931 to Jazdzyk Jr., and 5,046,740 to D'Eath teach a tee-shaped putter with the shaft connector element located near the striking face of the putter. These designs provide more visual alignment capability than do conventional putters but still maintain the distraction of prominent transverse elements.

In summary, my golfing experience, my tests of prior art putters, and my observations of other golfers have shown that conventional and other prior art putters provide either insufficient visual alignment features or have substantial distracting transverse or tapered features. Many golfers are unable to fully develop their natural abilities using these putters. It was this finding which led to further study of prior art putters and to the discovery of the present invention which fulfills the need for a putter having substantial alignment features, virtually no distracting transverse features, and the feel of a conventional putter.

OBJECTS AND ADVANTAGES

Accordingly, it is an object of the present invention to provide an improved putter which will enable the golfer to position and aim the putter head at address more precisely than has heretofore been possible.

It is further an object of the present invention to provide an improved putter which reduces the prominence of visual features which can distract the golfer during aiming and during the golfer's backswing and putting strokes. The unique configuration of the putter head in combination with the shaft connector element disclosed herein effectively masks from the golfer's view the most prominent and visually distracting feature of all prior art putters—the transverse blade of the putter.

It is further an object of the present invention to provide a putter which enhances the ability of a golfer to consistently aim and stroke the putter so that a vertical plane is defined by the target line and an intersecting line drawn normal to the striking face. The unique configuration of the putter head and the shaft connector element disclosed herein provides both tactile and visual feedback to the golfer to establish such alignment and positioning of the putter head relative to the target line.

It is further an object of the present invention to provide a putter configuration which will enhance the ability of a golfer to easily position the putter laterally relative to the ball and the target line. The unique configuration of the elongated body of the invention disclosed herein provides far better visual alignment feedback to the golfer than has heretofore been possible.

It is further an object of the present invention to provide a putter which has the feel of a conventional putter. The weight and balance of the putter of the invention disclosed herein results in a putter which feels similar to conventional putters during use.

It is further an object of the present invention to provide a putter which is in conformance with the rules of golf.

Still further objects and advantages of the present invention will become apparent from consideration of the following drawings and description of the invention.

DRAWING FIGURES

REFERENCE NUMERALS IN DRAWINGS

Figure 1:
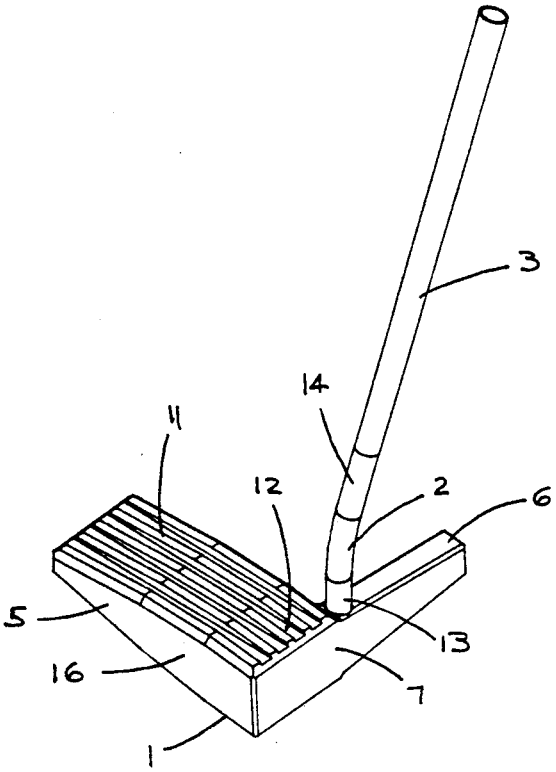
FIG. 1 is a perspective view of a putter made in accordance with the present invention. The upper portion of the shaft has been omitted.

1: Putter head
2: Shaft connector element
3: Shaft
5: Elongated body
6: Transverse member
7: Ball striking face
11: Plurality of lines
12: Grooves in the upper surface
13: Vertical segment of the shaft connector element
14: Angled segment of the shaft connector element
15: Proximal face of the elongated body
16: Distal face of the elongated body
17: Plurality of slots through the elongated body
A: Centerline of the vertical segment of the shaft connector element
B: Centerline of the angled segment of the shaft connector element
C: Centerline of the shaft
D: Extension of centerline of shaft
E: Target line
F: Longitudinal axis of the elongated body
G: transverse axis of the putter head
H: Line drawn normal to striking face
P: Lateral CG location of the putter head
Q: Dimension from the distal face of the elongated body to the end of the striking face
R: Locating dimension for the vertical segment

DESCRIPTION—FIGS. 1 TO 11

A preferred embodiment of the present invention is illustrated in FIGS. 1 to 4. The putter is shown in perspective in FIG. 1 and in general comprises a putter head 1, a shaft connector element 2, and a shaft 3. The upper portion of shaft 3 is omitted from all figures.

Figure 3:
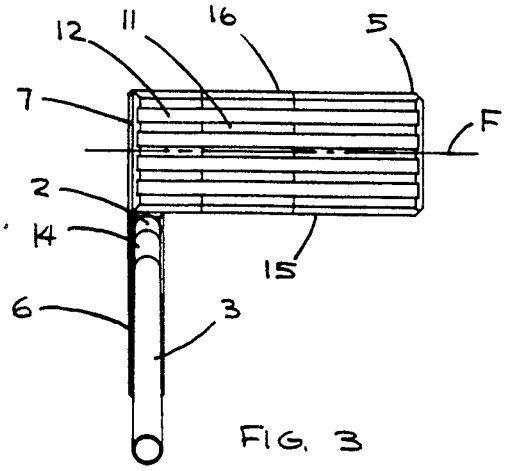
FIG. 3 is a plan view of the putter and partial shaft of FIG. 1.
Figure 5:
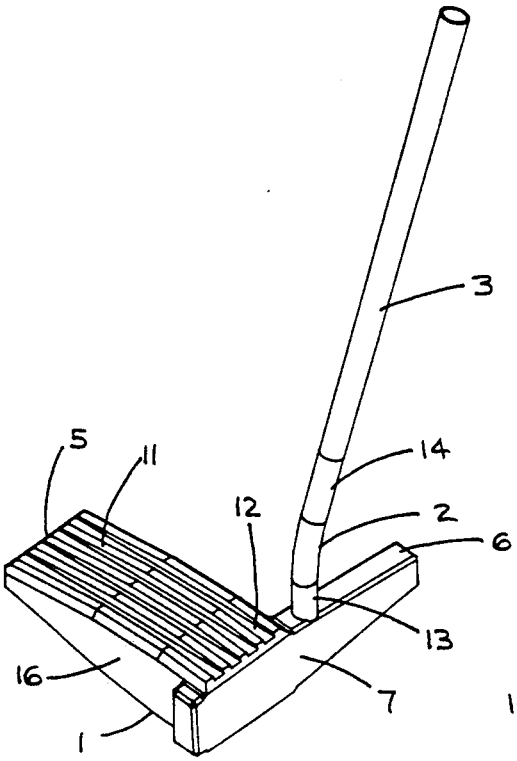
FIG. 5 is a perspective view of a second embodiment of a putter made in accordance with the present invention. The upper portion of the shaft has been omitted.
Figure 6:
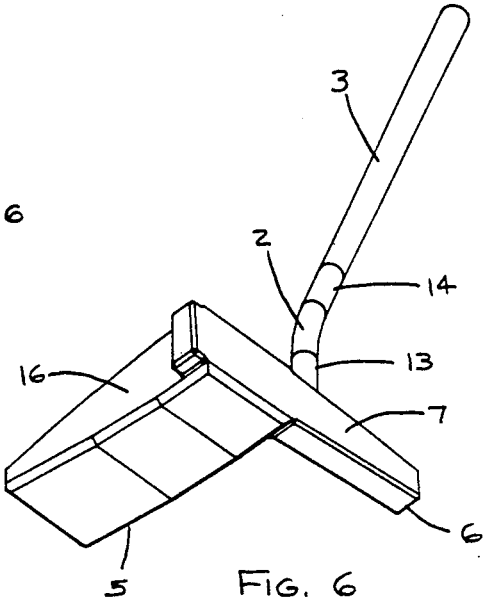
FIG. 6 is a perspective view from the underside of the putter and partial shaft of FIG. 5.
Figure 8:
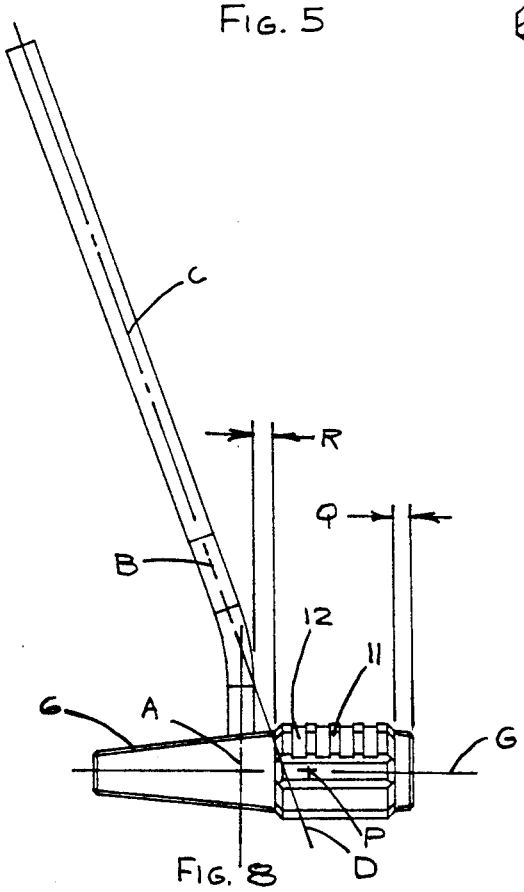
FIG. 8 is a rear elevation view of the putter and partial shaft of FIG. 5.
Figure 7:
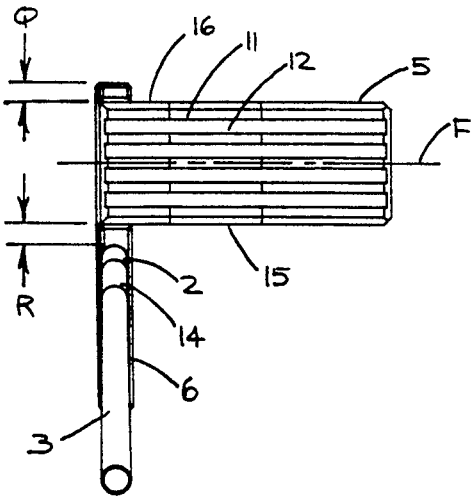
FIG. 7 is a plan view of the putter and partial shaft of FIG. 5.

Putter head 1 is el-shaped in plan view shown in FIG. 3. This shape is resultant from the combination of an elongated body 5 and an integral transverse member 6. A planar ball striking face 7 extends across the common front face of elongated body 5 and transverse member 6.

Figure 2:
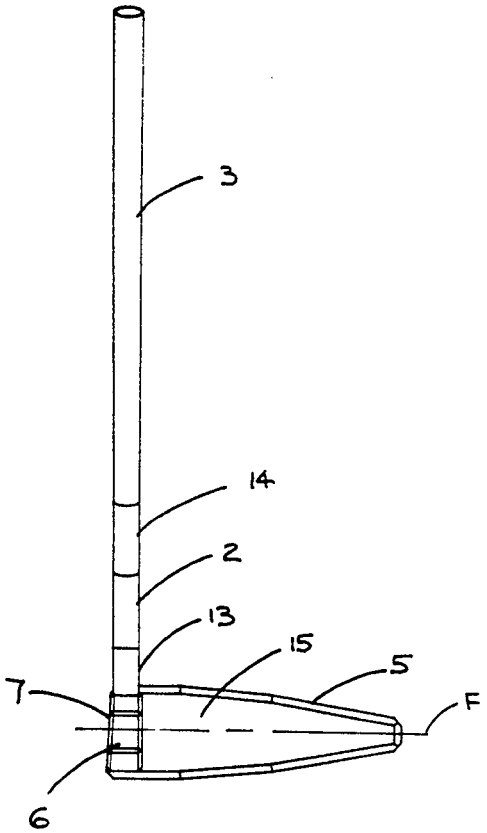
FIG. 2 is a side elevation view of the putter and partial shaft of FIG. 1.
Figure 4:
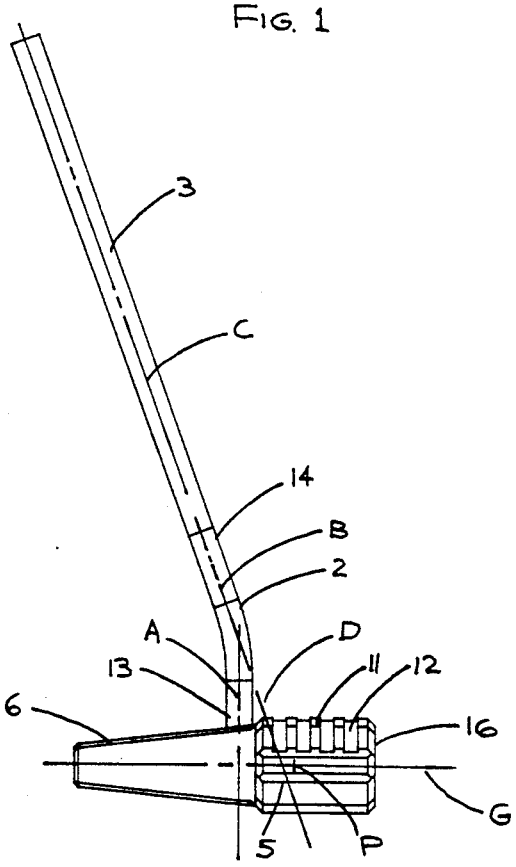
FIG. 4 is a rear elevation view of the putter and partial shaft of FIG. 1.

Elongated body 5 is rectangular in shape in plan view as shown in FIG. 3 and in rear elevation view as shown in FIG. 4. Body 5 has a generally convex upper surface and a generally convex lower surface as shown in FIG. 2. Although these surfaces are shown to be faceted, either or both of the surfaces may be smooth, curved surfaces.

A plurality of lines 11 are located on the upper surface of body 5, extending from near striking face 7 to the aft end of body 5 as shown in FIGS. 1 and 3. Although lines 11 are shown to be formed by a plurality of parallel grooves 12 formed into the upper surface of body 5, lines 11 may be painted on, applied by decal, or otherwise scribed onto the upper surface of body 5.

Shaft connector element 2 is attached to putter head 1. Connector element 2 comprises two segments, a vertical segment 13 and an angled segment 14. Centerlines A and B of segments 13 and 14, respectively, intersect and define a vertical plane approximately centrally positioned through transverse member 6. Vertical segment 13 is located adjacent to a proximal face 15 of body 5 as shown in FIG. 4. Angled segment 14 extends angularly above and over transverse member 6. Shaft 3 connects to the upper end of angled segment 14. An extension D of shaft centerline C passes approximately through a transverse center of mass P of putter head 1 as shown in FIG. 4. Although segment 13 is shown herein to be connected directly to the upper surface of transverse member 6, the segment may be connected to any other part of putter head 1 with a suitably shaped connecting link.

Putter head 1 of the preferred embodiment is generally dark in color, preferably black or dark green. The plurality of lines 11 on the upper surface of body 5 is light in color, preferably non-reflective white or light grey. Putter head 1 may be made of any suitable material. In the preferred embodiment the putter head is made of aluminum. The weight of putter head 1 is approximately 310 grams.

Striking face 7 is approximately 4.1 inches wide and body 5 is approximately 4.0 inches long. Body 5 is approximately 1.7 inches wide. The angles of lie and loft for the putter head are conventional.

FIGS. 5 to 8 show a second embodiment of the present invention. In these figures constituent elements of the putter corresponding or similar to those of the first embodiment are denoted by the same reference numerals as those used in FIGS. 1 to 4. The principal distinction between this embodiment and the previously described embodiment is that striking face 7 and transverse member 6 extend beyond a distal vertical face 16 of body 5 for a short distance Q. For this embodiment, shaft connector segment 13 is located at a distance R, approximately equal to Q, S from proximal face 15 of body 5. This positioning of segment 13 causes the putter head to appear symmetrical about body 5 to the golfer while minimizing the distraction of the lateral features.

Figure 9:
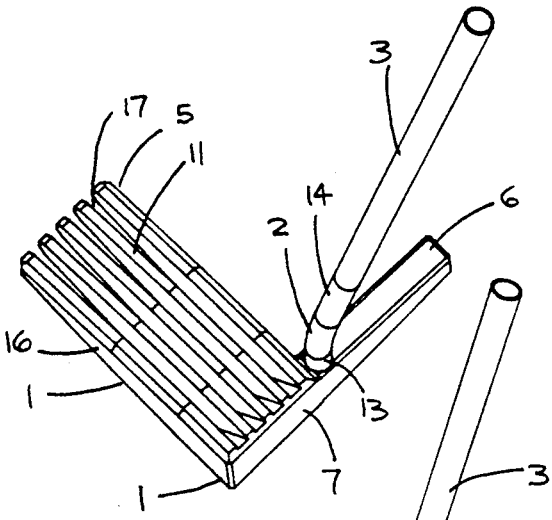
FIG. 9 is a perspective view of a third embodiment of a putter made in accordance with the present invention. The upper portion of the shaft has been omitted.
Figure 10:
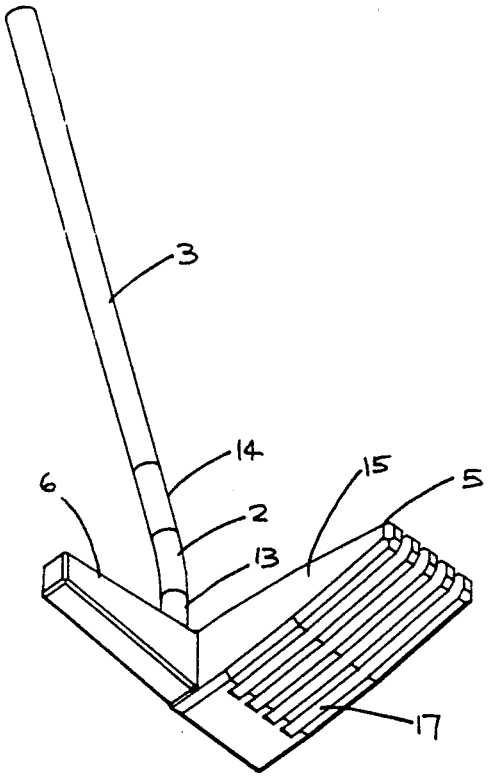
FIG. 10 is a perspective view from the underside of the putter and partial shaft of FIG. 9.
Figure 11:
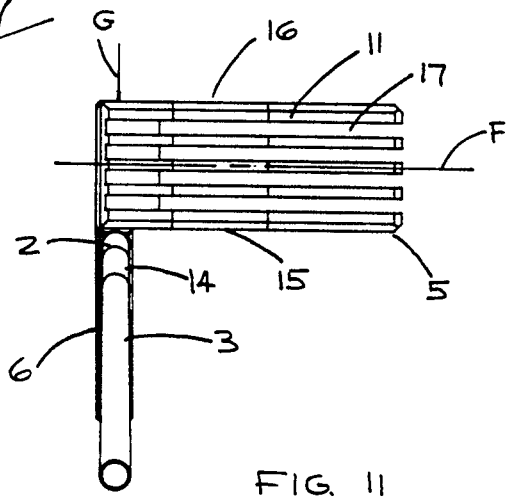
FIG. 11 is a plan view of the putter and partial shaft of FIG. 9.

FIGS. 9 to 11 show a third embodiment of the present invention. In these figures constituent elements of the putter corresponding or similar to those of the first embodiment are denoted by the same reference numerals as those used in FIGS. 1 to 4. The principal distinction between this embodiment and the previously described embodiments is that a plurality of parallel slots 17 is cut completely through body 5 to form the plurality of lines 11 on the upper surface of body 5. These slots extend from a point near striking face 7 through the aft end of body 5.

OPERATION—FIG. 12

The following is a detailed description of the operation of the putter disclosed herein. It is assumed in this description that the golfer's ball has landed on the putting surface. It is further assumed that the golfer has studied the green and has estimated a target line E and an initial speed he must impart to the ball to cause it to travel across the putting surface and fall into the hole.

Figure 12:
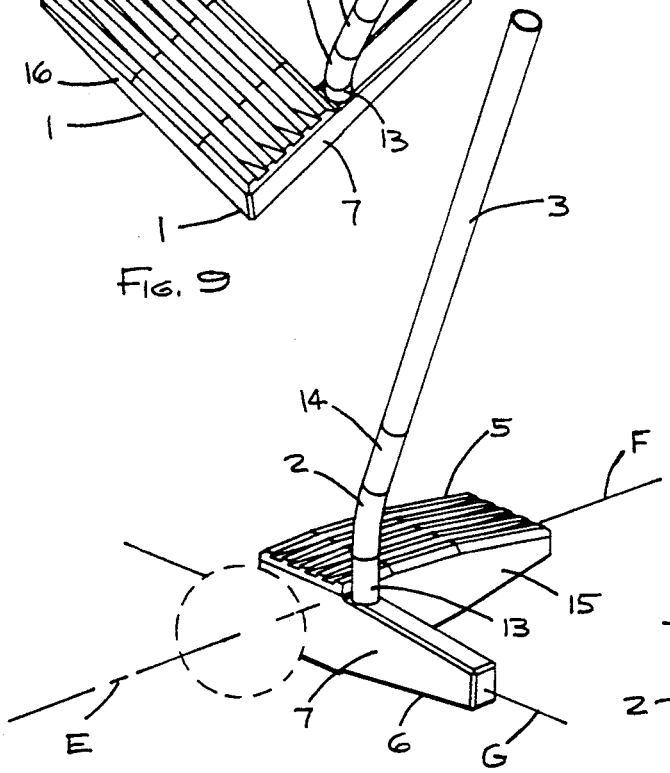
FIG. 12 is a perspective view of a putter made in accordance with the present invention. The upper portion of the shaft has been omitted, and a ball is shown for reference.

First, the golfer places the putter head behind the ball as shown in FIG. 12 and assumes a comfortable stance with his head positioned vertically above the putter head. The golfer next aligns the elongated body of the putter head with the target line. Because of the visual dominance of the plurality of lines on the upper surface of the putter head in conjunction with the ball, alignment of the putter with the target line is made simpler than for prior art putters. Additionally, because the overall width of the elongated body is approximately equal to the diameter of the golf ball, accurate lateral positioning of the putter head relative to the ball is easily accomplished.

The golfer next rotates the putter head about longitudinal axis F by rocking the putter head on the laterally flat bottom surface of the elongated body to ascertain that the base of the putter head lies flat on the putting surface. Sighting down along the vertical segment of the shaft connector element as well as sighting down the two parallel side faces of the elongated body further aid the golfer in positioning his eyes vertically above the putter head. Still further alignment assistance is provided the golfer by the appearance of the lines on the upper surface of the elongated body. Slight mispositioning of the golfer's head vertically above the putter head causes the lines to appear curved rather than straight. These visual aids enhance the golfer's ability to detect and correct errors in positioning the putter head at the correct angle of lie.

The golfer next moves the putter head about transverse axis G to a position where the shaft connector element and shaft effectively mask the transverse member of the putter from his view. These visual aids enhance the golfer's ability to detect and correct errors in positioning the putter head so that a line H drawn normal to the striking face will be inclined relative to the horizontal at the angle of loft for the putter.

Because the traverse member of the putter head is masked from the golfer's view by the shaft connector and shaft and because of the prominence of the lines on the top surface of the elongated body, the golfer is allowed to concentrate solely on those visual features which are in alignment with the target line.

The golfer is now ready to first take the putter head back away from the ball along an extension of the target line and then accelerate it forward to strike the ball. Because of the visual dominance and length of the plurality of lines on top of the putter head and because the overall width of the elongated body is approximately equal to the diameter of the ball, any rotation of the putter head or lateral excursion of the head is immediately apparent to the golfer.

Because centerline C of the shaft extends approximately through the lateral center of gravity P of the putter head, no rotational moment is applied to the putter head as the golfer applies acceleration forces to the head via the shaft during the backswing and forward putting strokes.

Finally, because the weight of the putter head disclosed herein is similar to that of conventional putters and because the loft and lie angles of the putter disclosed herein are similar to those angles for conventional putters, the putter disclosed in the present invention feels very much like a conventional putter to the golfer during the backswing and putting strokes.

SUMMARY OF THE INVENTION

Accordingly, it can be seen that the unique el-shape of the present invention in plan view, the placement and configuration of the shaft connector element which masks distracting lateral features, and the plurality of lines on top of the convex elongated body provide the golfer with much better visual feedback than is possible with conventional and other prior art putters.

It is desirable at address that the golfer position his eyes vertically above the putter head. Several features of the present invention assist the golfer in achieving this positioning: (1) the laterally flat bottom surface of the putter head provides tactile feedback to help the golfer establish that his putter is resting flat on the green at address. (2) the parallel, vertical faces of the elongated body and the vertical segment of the shaft connector element disappear once the golfer positions his eyes directly above the putter head, (3) the shaft connector element and the shaft mask the transverse member from the golfer's view, and (4) the lines on the convex upper surface of the elongated body appear straight. These features act together to provide the golfer maximum visual alignment feedback during the backswing and the putting strokes while masking distracting lateral features. The golfer's attention is necessarily drawn exclusively to those visual features which are most helpful to him: the features he wishes to align with the target line.

Finally, the overall width of the elongated body is approximately equal to the diameter of the ball and thus allows the golfer to develop consistency in striking the ball exactly at the same point on the ball striking face for every putt.

Although the description of the present invention contains many specifications, these should not be construed as limiting the scope of the invention but merely as illustrating some of the presently preferred embodiments of this invention. For example, other contours on the top and bottom surfaces of the elongated body, other shapes of the integral transverse member, other materials, et cetera may be used with similar results. Thus the scope of the present invention should be determined by the appended claims and their legal equivalents, rather than by the examples given.

I claim:

1. A golf putter comprising a putter head, a shaft connector element and a shaft having an imaginary centerline passing therethrough; said club head being generally L-shaped in plan view and resulting from a combination of an elongated body and an integral transverse member; said elongated body having upper and lower surfaces, an aft end and a proximal face; said putter head further including a ball striking face extending across a front face common to both said elongated body and said integral transverse member; said integral transverse member being positioned entirely to one side of and generally adjacent to said proximal face of said elongated member.

2. The golf putter of claim 1 wherein said shaft connector comprises at least one vertical segment connected to said putter head and at least one angled segment to which said shaft is connected, wherein each of said segments has an imaginary centerline passing therethrough with the centerlines of said segments intersecting above said transverse member approximately centrally of the collective horizontal length in front elevation view of both said elongated body and said transverse member, wherein the centerline of said angled segment is in alignment with the centerline of said shaft, and wherein said vertical segment is positioned adjacent to the proximal face of said elongated body.

3. The golf putter of claim 2 wherein an extension of the centerline of said shaft passes approximately through the lateral center of mass of said club head.

4. The golf putter of claim 1 wherein said elongated body is generally rectangular in plan view and in front elevation view.

5. The golf putter of claim 1 wherein the upper and lower surfaces of said elongated body are generally convex in side elevation view.

6. The golf putter of claim 1 wherein a plurality of longitudinal lines are formed on the upper surface of said elongated body and run the full length of said elongated body.

7. The golf putter of claim 1 wherein the overall horizontal length in front elevation view of said elongated body is approximately equal to the diameter of a golf ball.

8. The golf putter of claim 1 wherein a plurality of slots are formed in said elongated body and extend from the aft end of said body to a location near the striking face of said putter.

9. A golf putter comprising a putter head, a shaft connector element, and a shaft having an imaginary centerline passing therethrough; said club head being generally L-shaped in plan view and resulting from a combination of an elongated body and an integral transverse member; said elongated body having upper and lower surfaces, an aft end, a distal side and a proximal side; said putter head further including a ball striking face extending across a front face common to both said elongated body and said integral transverse member; said integral transverse member comprising a longer portion extending from the proximal side of said elongated body and a shorter portion extending from the distal side of said elongated body.

10. The golf putter of claim 9 wherein said shaft connector element is connected to said putter head and comprises at least one vertical segment and at least one angled segment to which said shaft is connected, wherein each of said segments has an imaginary centerline passing therethrough with the centerlines of said segments intersecting above said transverse member approximately centrally of the collective horizontal length in front elevation view of both said elongated body and said transverse member, wherein the centerline of said angled segment is in alignment with the centerline of said shaft and wherein said vertical segment is positioned proximally from the proximal side of said elongated body a distance equal to the horizontal length in front elevation view of said shorter portion of said transverse member.

11. The golf putter of claim 10 wherein an extension of the centerline of said shaft passes approximately through the lateral center of mass of said club head.

12. The golf putter of claim 9 wherein said elongated body is generally rectangular in plan view and in front elevation view.

13. The golf putter of claim 9 wherein the upper and lower surfaces of said elongated body are generally convex in side elevation view.

14. The golf putter of claim 9 wherein a plurality of parallel longitudinal lines are formed on the upper surface of said elongated body and run the full length of said elongated body.

15. The golf putter of claim 9 wherein the overall horizontal length in front elevation view of said elongated body is approximately equal to the diameter of a golf ball.

16. The golf putter of claim 9 wherein a plurality of slots are formed in said elongated body and extend from the aft end of said body to a location near the striking face of said putter.

* * * * *